United States Patent [19]

Fréchin

[11] 3,992,037

[45] Nov. 16, 1976

[54] SKI BINDING

[75] Inventor: Jean-Paul Fréchin, Chamonix, France

[73] Assignee: The Garcia Corporation, Teaneck, N.J.

[22] Filed: Dec. 15, 1975

[21] Appl. No.: 640,844

[30] Foreign Application Priority Data

Dec. 23, 1974 France ..... 74.42494

[52] U.S. Cl. ..... 280/613; 280/618; 280/637; 36/117

[51] Int. Cl.[2] ..... A63C 9/08

[58] Field of Search ..... 280/618, 613, 617, 611, 280/637, 636, 634, 633, 612, 616; 36/117

[56] References Cited

UNITED STATES PATENTS

| | | | |
|---|---|---|---|
| 3,061,325 | 10/1962 | Glass | 280/613 |
| 3,764,154 | 10/1973 | Witting | 280/637 |
| 3,785,668 | 1/1974 | Marker | 280/613 |
| 3,869,136 | 3/1975 | Jackson | 280/613 |
| 3,871,674 | 3/1975 | Bunn, Jr. | 280/637 |
| 3,893,682 | 7/1975 | Weinstein | 280/637 |
| 3,924,866 | 12/1975 | Schweizer | 280/637 |
| 3,936,006 | 2/1976 | Witting | 280/637 |

FOREIGN PATENTS OR APPLICATIONS

| | | | |
|---|---|---|---|
| 2,104,010 | 4/1972 | France | 280/618 |
| 2,173,710 | 10/1973 | France | 280/618 |

*Primary Examiner*—M. H. Wood, Jr.
*Assistant Examiner*—Milton L. Smith
*Attorney, Agent, or Firm*—Fitzpatrick, Cella, Harper & Scinto

[57] ABSTRACT

A ski binding comprises a sole-plate incorporating a spring-winder safety release mechanism releasably holding the plate on a ski by means of a flexible cable. A ski boot has a recessed housing defined by a peripheral wall fitting over the sole-plate. The boot sole and sole plate are locked together as a unit by locking means, such as pivoted levers or sliding bolts in the periphery of the plate engaging in corresponding recesses in the peripheral wall of the boot sole. These recesses may contain a compressible material preventing the recesses from being filled with snow or mud when the user walks. A control member is provided for voluntarily unlocking the boot from the soleplate, independently of the safety release mechanism.

23 Claims, 17 Drawing Figures

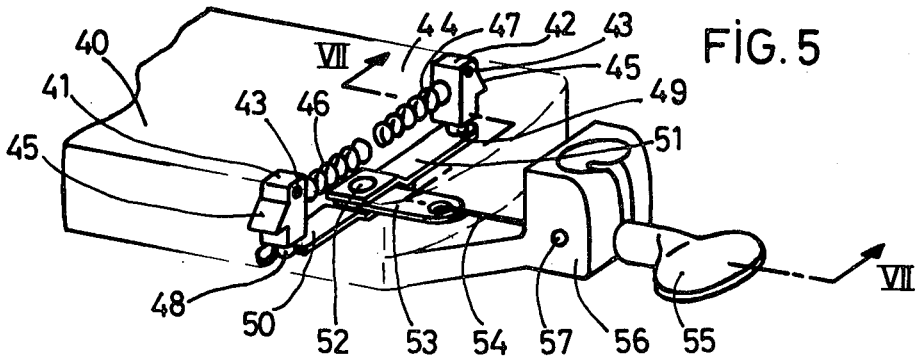
FIG. 5
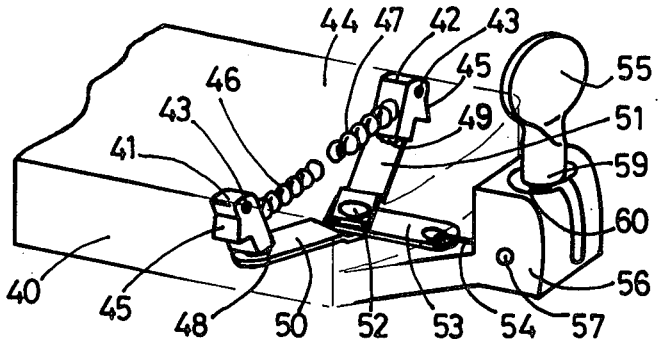
FIG. 6
FIG. 7
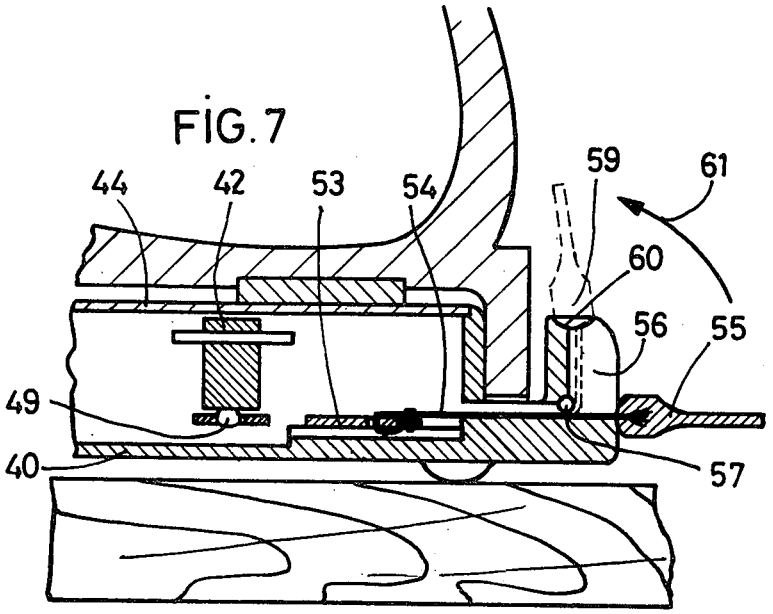

FIG. 8
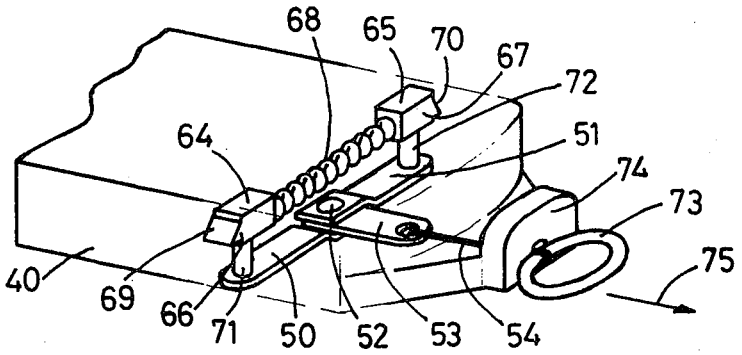
FIG. 10
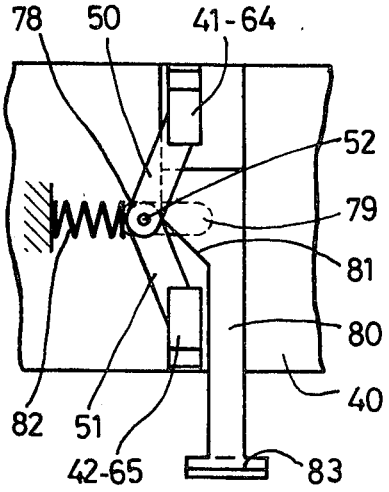
FIG. 9
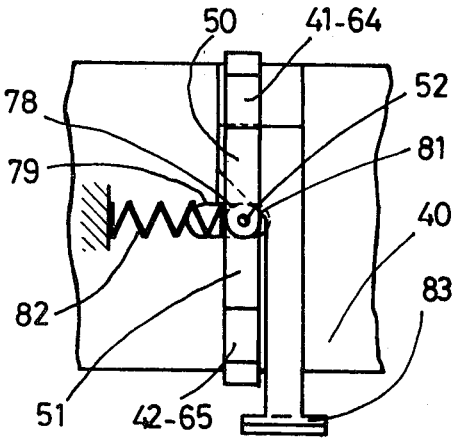
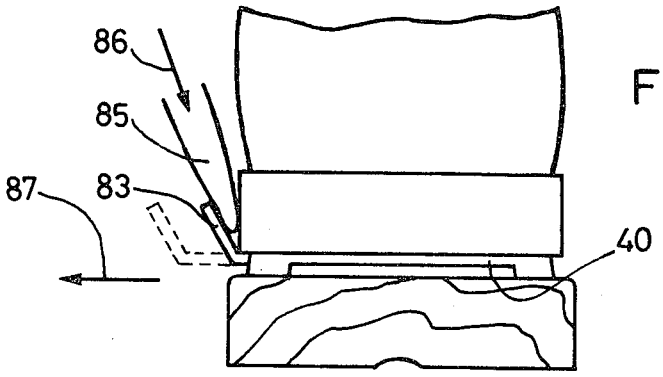
FIG. 11

SKI BINDING

The invention relates to ski bindings, specifically those of the type comprising an intermediate or sole plate on which a boot sole can be releasably locked, and a safety release binding mechanism for releasably securing the sole plate to a ski.

In known bindings of this type, for example those described in French Patennt Specification Nos. 2,104,010 and 2,173,710, the lower face of the boot sole is placed on the upper face of the sole plate, and secured by voluntarily releasable securing means at the front and rear of the sole plate. A disadvantage of such arrangements is that during skiing the skier's foot is excessively raised from the upper face of this ski. It has accordingly been proposed to incorporate the release mechanism of a such a binding in the sole of a boot, but this considerably increases the weight of the boot and hence hinders walking without the boot secured on a ski, and the binding mechanism risks becoming damaged during walking.

Various proposals have also been made for providing part of a release mechanism fixed on the ski surface to cooperate with the interior of a recessed housing in a boot sole, for example U.S. Pat. No. 3,061,325 (Glass). However, such arrangements suffer from the disadvantage that the housing in the boot sole cooperating with the fixed safety release device is liable to become fouled with snow, mud or other foreign matter when the skier walks without the ski, and such accumulated foreign matter is liable to impede the correct functioning of the safety release mechanism when the boot is secured on the ski. Any such modification of the operation of the safety binding mechanism can have unfortunate results such as injury if the binding mechanism should be jammed.

An object of the invention is to provide a ski binding combination of the type mentioned at the outset which avoids or overcomes the disadvantages of the discussed prior art arrangements.

The invention therefore provides, in combination, a ski boot having a rigid sole, a sole-plate, means for firmly locking the boot sole and sole-plate together to form a sole-plate and boot unit, means for voluntarily unlocking the boot sole from the sole-plate, and a safety binding mechanism including safety release means for releasably holding the sole-plate on a ski while allowing release of the sole-plate and boot unit from the ski in the event of a force exceeding a given value acting on the sole-plate and boot unit, said safety release means being independent of said voluntary unlocking means. Accordingly to the invention, in such a combination, the boot sole has a peripheral wall having an inwardly-directed face of substantially equal thickness to the thickness of the sole-plate to define a recessed housing in the boot-sole of shape and dimensions to receive the sole-plate therein, and said means for firmly locking together the boot-sole and the sole-plate comprises complementary locking means disposed at at least two substantially opposite locations of the periphery of the sole-plate and of said face of said wall of the boot sole on facing parts of the periphery of the sole-plate and of said wall.

In this manner, during skiing the skiers feet can remain relatively close to the ski surfaces and, for walking, the recessed housing in the boot sole provides an appreciable saving in weight. Further, any dirt or snow which may possibly accumulate in the boot sole housing will not, when the boot is fitted on a ski, in any way impede or modify the safety release mechanism. At most, it will merely hinder locking of the boot on the sole plate but when the boot is so locked any remaining dirt will have no effect whatsoever on the operation of the safety release binding mechanism which is entirely independent of the voluntary boot locking and unlocking means.

The present invention is particularly suited for the sole plate type binding sold under the Trademark BURT. However, the combination of the invention is equally applicable to other forms of safety binding mechanism which include a sole plate.

Said complementary locking means may comprise a plurality of locking members protruding from the periphery of the sole-plate and means defining a plurality of corresponding recesses in said face of said wall of the boot sole to receive said locking members, at least one of said locking members being movably mounted in the sole-plate, and comprising means for biasing said movable locking member(s) to protrude from the sole-plate in an operative locking position, said voluntary unlocking means including a piece cooperating with at least one said movable locking member and displaceable voluntarily to retract said movable locking member from said operative locking position against the action of said biasing means.

To reduce the effects of any snow or dirt accumulating in said recesses in the boot-sole, each said recess in said face of the peripheral wall of the boot sole may house an elastically compressible element which fills the recess in the absence of engagement in the recess of the corresponding locking member, and is compressible in the recess by the engagement of a corresponding locking member therein.

The accompanying drawings show, by way of example, several embodiments of the invention. In the drawings:

FIGS. 5 and 6 are schematic perspective views of part of a second embodiment;

FIG. 7 is a cross-section along line VII—VII of FIG. 5, showing in addition the boot and ski;

FIG. 8 is a schematic perspective view of part of a third embodiment;

FIGS. 9 and 10 are schematic plan views of part of a fourth embodiment;

FIG. 11 is a schematic end-on view of the fourth embodiment;

Figure 1:
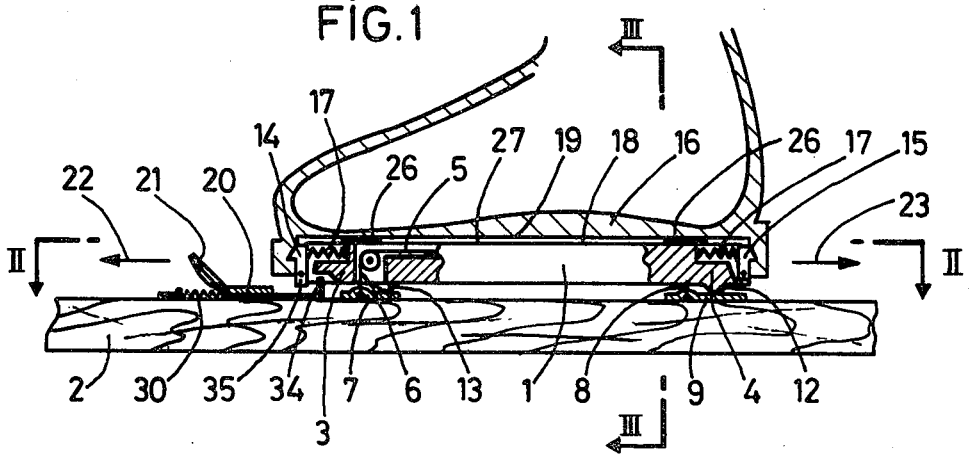
FIG. 1 is a cross-section along line I—I of FIG. 2 of a first embodiment.
Figure 2:
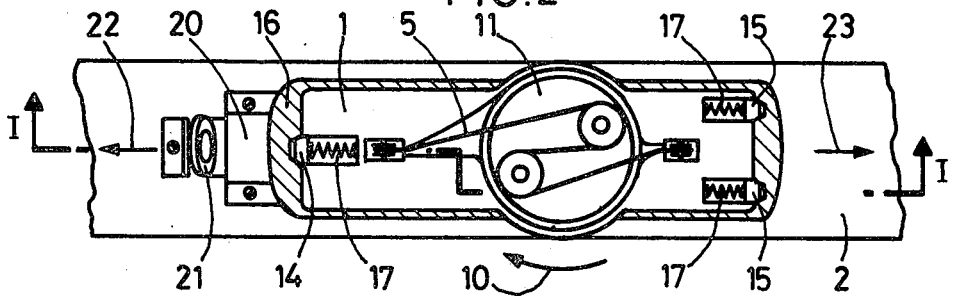
FIG. 2 is a plan view and cross-section along line II—II of FIG. 1.

With reference to FIGS. 1 and 2, an intermediate or sole plate 1 forming part of a ski-binding, has ends 3 and 4 which tend to be constantly held against the top face of a ski 2 by a flexible cable 5. A cable tensioning device, comprising a drum 11 carrying pullies about which cable 5 is wound as shown in FIG. 2 and a spiral spring (not shown) housed in drum 11 and biasing it as indicated by arrow 10 (FIG. 2), maintains cable 5 constantly under tension. One end 6 of cable 5 is secured to an anchor plate 7 fixed on ski 2 and its other end 8 to an anchor plate 9. In this manner embossments 12 and 13 towards the rear and front ends of plate 1 are constantly held down against the anchor plates on ski 2.

Figure 3:
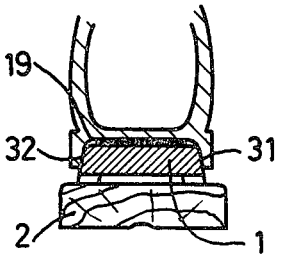
FIG. 3 is a cross-section along line III—III of FIG. 1.

A ski boot has a sole 16 with a recessed housing 18 in its lower face for receiving the plate 1. Housing 18 has a flat central base 19 against which the upper face 27 of plate 1 bears with interposed elastically-compressible elements 26, of an elastomer for example. Housing 18 is surrounded by a peripheral wall having an inwardly-directed face 32 whose dimensions are just sufficient to receive a corresponding peripheral face 31 of plate 1. As shown in FIG. 3, the side portions of these complementary face 31, 32 are inclined at an obtuse angle to the base 19 of housing 18, at least around a major portion thereof.

Figure 4:
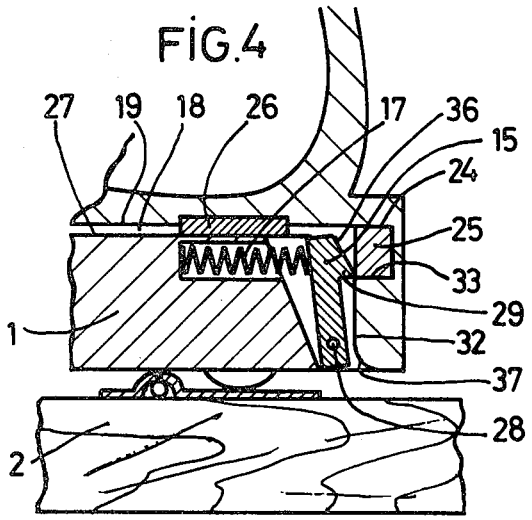
FIG. 4 is an enlargement of part of FIG. 1.

The sole 16 is releasably locked to plate 1 by a first mobile locking element 14 and two second mobile locking elements 15 disposed respectively at the front 3 and at the rear 4 of plate 1, at substantially opposite portions of its peripheral face 31. As shown in FIG. 4, these locking elements 14 and, as shown, 15, may be formed as levers pivoted at 28 to plate 1, each lever having a beak 29 which is biased by a spring 17 into a corresponding recess 24 in the face 32 of sole 16. Recess 24 has a square-section profile 33 for cooperation with beak 29, and is filled with an elastically-compressible element foam material 25 which, when the beak 29 does not engage in the recess, fills the entire volume of the recess, but is elastically compressible to receive the beak 29. The beak 29 has an inclined face 36 for cooperation with a rounded section 37 on the edge of wall 32.

A manually-actuable device for voluntarily unlocking the sole 16 (and hence the boot) from the plate 1 is disposed on ski 2 in front of the fitted boot. If comprises a piece 21 slidably mounted in a rail 20, and movable in direction 22 against the action of a biasing spring 30. The piece 21 has a part, accessible when a boot is secured on ski 2, which is shaped to receive the end of a ski pole, by which it can be pushed. Piece 21 has an upstanding end 34 disposed under the fitted plate 1 behind a lower projection 35 of pivoted lever 14.

When the skier desires to secure his boot to the ski 2, he places sole 16 above plate 1 (which is held on ski 2) and presses down to make the plate 1 penetrate in housing 18, the rounded edges 37 cooperating with inclined faces 36 to retract levers 14, 15. As the boot becomes seated, the elastomer elements 26 are compressed between faces 27 and 19 until beaks 29 engage in recesses 24 under the action of springs 17, each beak 29 thus compressing the foam element 29 into the corresponding recess 24 and lockably engaging with the corresponding profile 33. The sole 16 is thus firmly locked onto plate 1, with no appreciable lateral play due to the mating engagement of inclined faces 31, 32 and with the elastomer elements 26 absorbing any vertical play. During skiing, the boot cannot unwantedly become unlocked from the plate 1 when a force tends to separate the boot from the ski. Instead, the boot and plate 1 are locked together as a unit, and safety release is provided for by the cable 5 which can be unwound and hence permit the boot/plate unit to temporarily move away from ski 2.

When the skier desires to remove the boot from ski 2, he places the end of a ski pole in piece 21 and pushes it in direction 22. As the end 34 moves, it abuts the projection 35 and pivots lever 14 to remove its beak 29 from the corresponding recess 14. The skier can then lift up the toe end of sole 16, and release the heel end from levers 15 by rearwardly moving the boot as indicated by arrow 23. The plate 1 thus remains held on ski 2 when the skis are not being used, and is always ready for the boot to be locked thereon for skiing.

Also, the boot is considerably lightened when it is not fitted on the ski, and the lower edge of the peripheral wall and the recess 19 provide an excellent adherence, especially for walking over snow. Furthermore, as soon as the beaks 29 have been withdrawn from recesses 24, the foam material 25 entirely fills the recesses 24 and prevents them from being obturated by snow or mud during walking. Locking of the boot back onto plate 1 cannot normally thus be impeded. However, even if foreign bodies become accidentially introduced into the recesses 24 during walking, all that will happen is that fitting of the boot on the plate 1 will be hindered, and once the boot is fitted there can be no later undesired consequence in impeding correct and safe operation of the safety binding in the event of a fall when skiing, as the safety release mechanism does not cooperate with the soiled part of the sole. The inclination of face 32 also reduces the tendency for snow to accumulate in housing 19 during walking, and assists removal of any snow that may accumulate in the housing 19.

It is to be noted that unlocking of the boot from the sole-plate can only take place voluntarily, and does not take place in any other way, e.g. to complement the safety release mechanism.

FIGS. 5 to 7 show a second embodiment of the invention comprising a sole plate 40 having, on its lateral edges close to one end thereof, two mobile locking elements (equivalent to levers 14, 15 of FIG. 1) in the form of levers 41, 42 each pivoted about a pin 43 parallel to the side edges of plate 1. Levers 41, 42 each have a beak 45 which tends to be constantly biased by a respective spring 46, 47 into a corresponding recess in the facing wall of the boot sole, similar to recesses 24 of the first embodiment. The lower ends of levers 41, 42 are connected by respective ball-joints 48, 49 to levers 50, 51 pivotally connected by a pin 52 to form a toggle. A link 53 connects pin 52 to a central cable 54 fixed to a manually-operable control lever 55 disposed at the front or rear end of plate 40. Cable 55 passes through an opening in an extension or support 56 integral with the end of plate 40 and projecting beyond the rim of the supported boot. Between line 53 and lever 55, cable 54 passes under a guide pin 57 passing through support 56. Lever 55 may occupy either of two angular positions relative to support 56, a first positions (FIGS. 5 and 7) in which levers 41 and 42 are held apart in a boot-locking position by toggle levers 50, 51 disposed in extension of one another, and a retracted second position (FIG. 6 and dashed-line in FIG. 7) in which toggle levers 41 and 42 are pulled to a boot unlocking position against the action of springs 46, 47. Lever 55 is held in this raised position by engagement of a rounded end 59 in a dished recess 60 in support 59. All of the other parts of the second embodiment are the same as for the first embodiment.

In use of the second embodiment, before fitting a boot on the ski, the lever 55 is placed in its lowered first position, Fitting of the boot then takes place as described for the first embodiment. Voluntary unlocking of the boot from plate 40 takes place by lifting lever 55 as indicated by arrow 61 to its second position. The boot sole can then be lifted off of plate 40. Lever 55 can then be returned to its first position, ready to lock a boot in position once more.

The third embodiment shown in FIG. 8 is similar to the second, but levers 41, 42 are replaced by bolts 64, 65 slidably mounted in plate 40 parallel to its top surface and transversal to its longitudinal axis. Bolts 64, 65 have ends 66, 67 respectively which are biased outwardly by a single spring 68 into corresponding recesses in the facing wall of a boot sole, now shown. The ends 66, 67 have inclined upper faces 69, 70 for facilitating fitting of a boot sole. The lower faces of bolts 64, 65 carry shafts 71, 72, replacing the ball-joints of the second embodiment, and to which toggle levers 50, 51 are connected. The previous control lever 55 and its support 56 are replaced by a simple pull-ring 73 which bears against an appropriately-shaped projecting support 74 on plate 40. All of the other elements are identical to those of the second embodiment. Fitting of a boot onto the ski takes place in the same way as before, the action of the sole on inclined faces 69, 70 producing retraction of the bolts 64, 65 against the action of spring 68, until the bolts engage in the corresponding recesses of the sole when the latter comes to bear on plate 40. Unlocking of the boot from plate 40 takes place by pulling ring 73 as indicated by arrow 75, which produces withdrawal of bolts 64, 65 against the action of spring 68, and freeing of the boot sole. This movement of ring 73 can be achieved manually by introducing the end of a ski pole therein.

As a variation, the ring 73 and support 74 of the third embodiment could be replaced by the lever 55 and support 56 of the second embodiment. Likewise, in the second embodiment, the lever 55 and its support 56 could be replaced by the ring 73 and support 74 of the third embodiment.

FIGS. 9 to 11 show a fourth embodiment which is a variation of the second or third embodiment. In this invention, the means for controlling opening of levers 41, 42 (FIG. 5) or of bolts 64, 65 (FIG. 8) once more include toggle levers 50, 51 articulated together about a pin 52, but one of the ends of this pin 52 has a cylindrical head 78 slidably mounted in a guide groove 79 extending along the axis of plate 40. The link 53, cable 54, lever 55 or ring 73, and the respective support 56 or 74 are replaced by a piece 80 sliding transverse to plate 40, piece 80 having an inclined cam face 81. Head 78 is biased against cam face 81 by a compression spring 82. Piece 80 is extended outwardly by an actuating part protruding beyond one of the lateral faces of place 40. This actuating part is in the form of an upturned external end inclined at an angle of about 45° to the periphery of the boot sole. All of the other elements are identical to those of the previously described second and third embodiments.

Only the operation of the means controlling voluntary unlocking of a boot is different from the previous embodiments. FIG. 9 shows the elements in a rest position, when a boot is fitted and locked on the plate 40, or when a boot is completely removed from the plate; FIG. 10 shows the same elements during unlocking of a boot. To do this, it suffices, as for example shown in FIG. 11, to insert the tip 85 of a ski pole between the boot sole and end 83 in direction 86 and move end 83 outwards as indicated by arrow 87. Cam face 81 thus pushes head 78 against the action of spring 82 so that levers 41, 42 or bolts 64, 65 respectively are withdrawn and the boot sole is free to be lifted off of the plate 40.

This variation of the second and third embodiments may also be modified, by replacing the bent end 83 by a pull-ring able to be pulled out by the tip of a ski pole.

Figure 12:
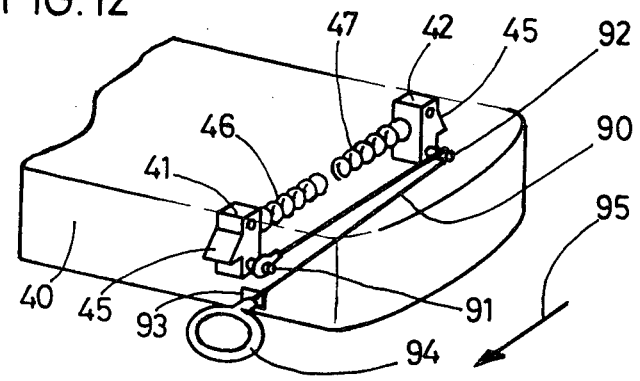
FIGS. 12 to 16 are schematic perspective views of parts of fifth to ninth embodiments respectively.

FIG. 12 shows a fifth embodiment of the invention in which the withdrawal of levers 41, 42 is controlled by a flexible cable 90 one end of which is attached to a pin 91 on the first lever 41. A median part of cable 90 passes about a pin 92 on the second lever 42, and its second end has a manually actuable pull-piece such as a pull-ring 94 disposed externally of a lateral face of plate 40, adjacent the bottom of plate 40 to be accessible even when a boot is locked on the plate 40. An opening 93 is provided in plate 40 for passage of the cable 90. Otherwise, the levers 41, 42 and springs 46, 47 are the same as in the second embodiment (FIG. 5).

Fitting and locking of a boot on plate 40 takes place as for the second embodiment. To unlock and remove the boot, it suffices to pull ring 94 in direction 95,, either by hand or using the tip of a ski pole, to cause withdrawal of the beaks of levers 41, 42 and hence allow removal of the boot from plate 40.

Figure 13:
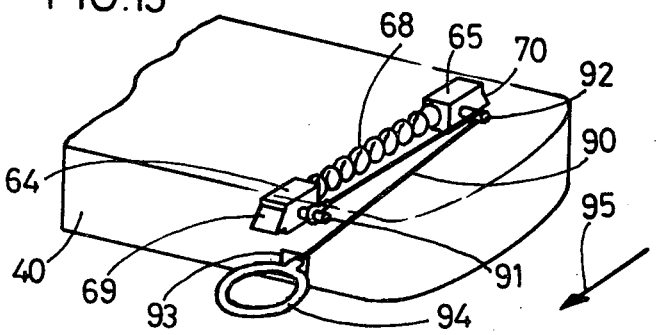

FIG. 13 shows a sixth embodiment which differs from the fifth embodiment only in that levers 41, 42 are replaced by bolts 64, 65 as in the third embodiment. Operation of this sixth embodiment is the same as that of the fifth embodiment.

Figure 14:
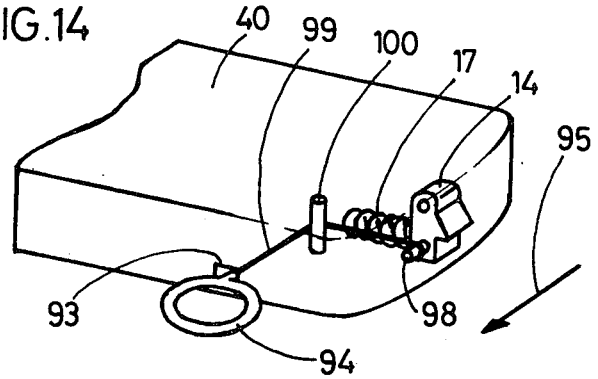

The seventh embodiment shown in FIG. 14 has a lever 14 located, as in the first embodiment, at an end of plate 40, but pivoted at its upper end and biased by spring 17 acting against its lower end. The lower end of lever 14 also carries a pin 98 to which an end of a flexible cable 99 is attached. A median part of cable 99 passes about a fixed pin 100, to make an angle of 90°, and the second end of cable 99 carries a pull-ring 94 protruding from a lateral edge of plate 40, as in the preceding two embodiments.

Operation of the seventh embodiment is the same as for the first. To unlock and remove a boot it suffices to pull out the ring 94 which causes withdrawal of the beak of lever 14, against the action of spring 17.

In a variation, not shown, of the seventh embodiment, lever 14 is replaced by a bolt similar to those of FIG. 8. Operation remains the same.

The pull-ring 94 of the fifth, sixth and seventh embodiments could be replaced by a sliding actuating member, similar to member 80–83 of FIGS. 9, 10 and 11, connected to the second end of cable 99. In another variation, the actuating member could be located at the front or rear end of plate 40, the lever 14 (FIG. 14) being placed on a side of plate 40.

Figure 15:
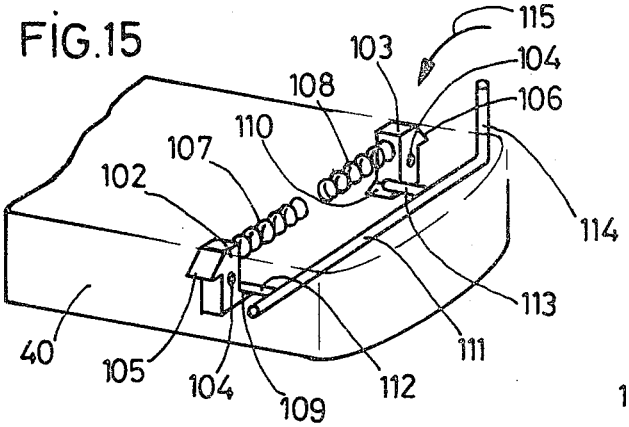

FIG. 15 shows an eighth embodiment comprising a sole-plate 40 carrying on its lateral sides near one of its ends two mobile locking members in the form of levers 102, 103 each pivoted in a median part thereof about a pin 104 parallel to the plate axis. The upper end of each lever has a beak 105, 106 respectively and is biased outwardly by a respective spring 107, 108 to engage in a corresponding recess in the boot sole. The lower end of each lever has a respective inwardly-facing ramp 109, 110. Means for controlling withdrawal of the levers 102, 103 comprise a transverse rod III parallel to the plate surface. Rod 111 carries two lateral projections 112, 113 facing the ramps 109, 110, and is rotatable about its longitudinal axis by means of a control member formed by a bent end 114 of rod 113, accessible outside one face of plate 40 even when a boot is fitted. All of the other elements are the same as for the first embodiment.

Fitting and locking of a boot on plate 40 takes place as previously described. To unlock the boot, the control member 114 is rotated in direction 115. Projections 112, 113 both move down by rotation in direction 115 and, by acting on ramps 109, 110, cause retraction of beaks 105, 106 and freeing of the boot.

Figure 16:
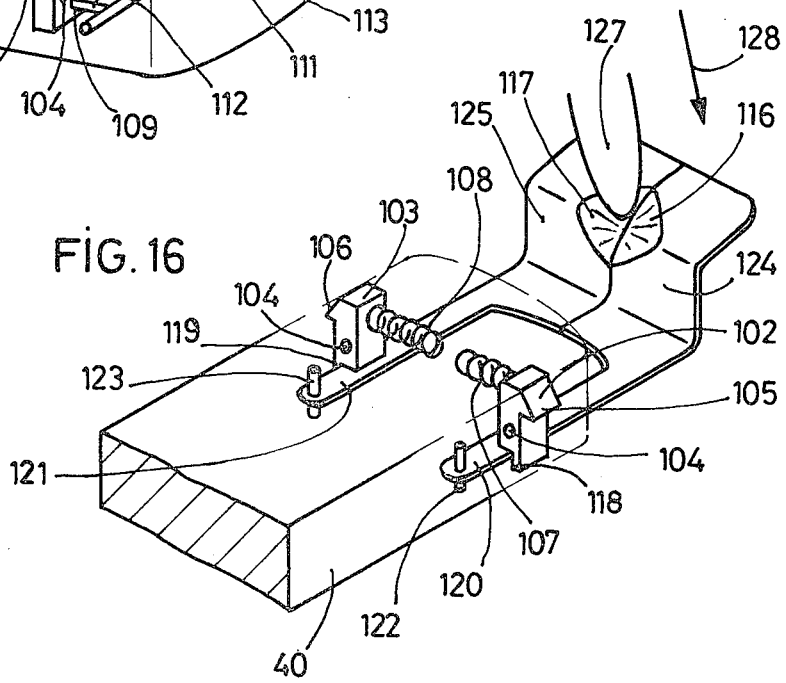

The ninth embodiment (FIG. 16) comprises a sole plate 40 carrying levers 102, 103 as in the preceding embodiment, except that the ramps 109, 110 are replaced by downward, extensions 118, 119 respectively. Means for controlling retraction of the levers are formed of two control levers or members 120, 121 pivoted on plate 40 about pins 122, 123 fixed perpendicular to the upper face of plate 40. Members 120, 121 have parts, disposed parallel to one another at rest, facing the extensions 118,119 of the levers. Members 120, 121 are extended by projecting ends 124, 125 arranged side-by-side at rest and projecting from the front or rear end of plate 40. Ends 124, 125 are adapted so that they may be voluntarily moved apart from one another; for example, they have complementary substantially conical recessed parts 116, 117. All of the other elements are the same as those of the eighth embodiment.

Placing and locking of a boot takes place as described previously. To unlock a boot, a tip 127 of a ski pole is inserted in the complementary recesses 116, 117 and a pressure exerted in direction 128. Ends 124, 125 are thus separated as are members 120, 121 which tip the respective levers 102, 103 by their extensions 118, 119. Beaks 105, 106 are thus made to retract, and the boot is freed.

Figure 17:
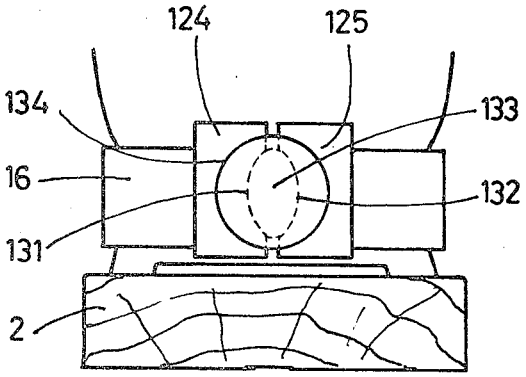
FIG. 17 is a schematic end on view oof a varied form of the ninth embodiment.

FIG. 17 shows a variation of the ninth embodiment in which the complementary recesses 116, 117 are replaced by facing arcuate edges 131, 132 defining an oval opening. Through this opening passes a shaft of corresponding oval section mounted on plate 40, and having an external control knob 133. The other elements are the same as for the ninth embodiment.

To unlock and remove a locked boot, it suffices to manually turn knob 134 by a quarter of a turn. In this manner, shaft 133 moves apart edges 131, 132 and the corresponding control elements 120, 121 actuating levers 102, 103.

In all of the described embodiments with levers 15 as in FIG. 1, these levers can be replaced by one or more spring-urged bolts. Alternatively, levers 15 could be replaced by one or more fixed locking members of similar shape to the described lever beaks or bolt latches. These non-actuable levers, bolts or fixed locking members may be situated at the front or rear end of the sole plate, opposite the end provided with an actuable locking member.

In a variation of the second, third, fourth, fifth, sixth, eighth and ninth embodiments, the described mobile locking members (levers or bolts) are disposed substantially mid-way along the lateral faces of the sole plate and form the entire locking mechanism, without any additional non-actuable locking members.

In yet another variation of the second to sixth, eighth and ninth embodiments, the described mobile locking members are disposed in the front and rear ends of the sole-plate and form the entire locking memchanism. Hence, for example, the bolts 64, 65 of FIG. 8 would be placed at the front and rear ends of plate 40, and pull-ring 73 located on a lateral part of plate 40. Likewise, for FIG. 9, the bolts or levers would be at the front and rear ends of plate 40, and the bent actuating end at the front or rear end. The levers 41, 42 of FIG. 12 and bolts 64, 65 of FIG. 13 could also be placed at the front and rear ends of plate 40, and pull ring 94 adjacent one of them, at the front or rear end. Similarly, the levers 102, 103 of FIGS. 15 and 16 could be placed at the front and rear ends of plate 40; the control member 114 (FIG. 15) would be close to one of the levers, at an end of the plate, whereas the control means (116, 114; 117, 125) of FIG. 16 would be located on a lateral part of plate 40.

The combination according to the invention can be used with various types of safety bindings with a sole-plate, when it is desired that the sole plate should not remain fixed to the boot sole for walking when the boot is not secured on a ski, without the boot sole being excessively above the upper surface of the ski during skiing.

What is claimed is:

1. In combination, a ski boot having a rigid sole, a sole-plate, means for firmly locking the boot sole and sole-plate together to form a sole-plate and boot unit, means for voluntarily unlocking the boot sole from the sole-plate, and a safety binding mechanism including safety release means for releasably holding the sole-plate on a ski while allowing release of the sole-plate and boot unit from the ski in the event of a force exceeding a given value acting on the sole-plate and boot unit, said safety release means being independent of said voluntary unlocking means, wherein the boot sole has a peripheral wall defining a recessed housing in the boot sole of shape and dimensions to receive the sole-plate therein, and said means for firmly locking together the boot sole and the sole plate comprises complementary locking means disposed at at least two substantially opposite locations of the periphery of the sole-plate and said wall of the boot sole on facing parts of the periphery of the sole-plate and of said wall.

2. A combination according to claim 1, in which said housing in the boot sole has a planar central base, and at least a major part of the inwardly-directed face of said peripheral wall of the boot sole is inclined at an obtuse angle to said planar central base of the housing.

3. A combination according to claim 1, in which said complementary locking means comprises a plurality of locking members protruding from the periphery of the sole-plate and means defining a plurality of corresponding recesses in the inwardly-directed face of said wall of the boot sole to receive said locking members, at least one of said locking members being movably mounted in the sole-plate, and comprising means for biasing said movable locking member(s) to protrude from the sole-plate in an operative locking position, said voluntary unlocking means including a piece cooperating with at least one said movable locking member and displaceable voluntarily to retract said movable locking member from said operative locking position against the action of said biasing means.

4. A combination according to claim 3, comprising in each said recess in said face of said wall an elastically compressible element which fills the recess in the absence of engagement in the recess of the corresponding locking member, and is compressible in the recess by the engagement of a corresponding locking member therein.

5. A combination according to claim 2, comprising at least one elastically compressible element carried by one of said central base of said housing in the boot sole and an upper face of said plate for compression between said central base and said upper face when said plate is locked in said housing.

6. A combination according to claim 3, in which said plate has front and rear ends and a longitudinal axis, and at least one said movable locking member is a lever pivotally mounted at one of the front and rear ends of said plate, about an axis parallel to the upper face of said plate and transverse to said longitudinal axis, said lever having a protruding beak forming a latch engageable in a corresponding recess in said face of said wall of the boot sole under the action of said biasing means.

7. A combination according to claim 6, in which said voluntary unlocking means comprises a piece slidably mounted on a ski, said piece including a first part accessible for displacement of said piece when said boot is locked on said plate and held on the ski and a second part extending under said plate when said plate is held on said ski, said second part cooperating with one of said levers to disengage its protruding beak from said corresponding recess in response to displacement of said piece.

8. A combination according to claim 3, comprising two movable locking members disposed at opposite parts of the periphery of said plate each formed by a lever pivotally mounted about an axis parallel to said opposite parts of said periphery of said plate, each lever having a protruding beak engageable in a corresponding recess in said face of said wall of the boot sole under the action of said biasing means.

9. A combination according to claim 3, in which at least one said movable locking member is a bolt slidably mounted in said plate, along a direction parallel to the upper face of said plate.

10. A combination according to claim 9, comprising two movable locking members disposed at opposite parts of the periphery of said plate each formed by a bolt slidably mounted in said plate along a direction parallel to the upper face of said plate.

11. A combination according to claim 3, comprising two movable locking members disposed at opposite parts of the periphery of said plate, said voluntary unlocking means comprising a flexible cable connected to simultaneously withdraw said locking members from their operative locking position in response to traction on said cable, and a control member disposed externally of said plate for applying a traction to said cable.

12. A combination according to claim 3, in which said plate has front and rear ends and lateral faces, and comprising a movable locking member disposed at one of said ends of said plate, said voluntary unlocking means comprising a flexible cable connected to withdraw said movable locking member from its operative locking position in response to traction on said cable, and a control member disposed externally of a lateral face of said plate for applying a traction to said cable.

13. A combination according to claim 3, comprising two movable locking members disposed at opposite parts of the periphery of said plate, said voluntary unlocking means comprising toggle means connected to simultaneously withdraw said movable locking members from their operative locking position in response to displacement of said toggle means, and a control member disposed externally of said plate for displacing said toggle means.

14. A combination according to claim 13, in which said plate has front and rear ends and lateral faces and said movable locking members are disposed at opposite parts of said lateral faces of said plate, said control member being disposed at one of said ends of the plate and being connected to said toggle means by a traction-transmitting member.

15. A combination according to claim 14, in which said one end of the plate comprises an extension protruding beyond the sole of a boot locked on said plate, and said control member is a lever mounted on said extension of said plate for movement between two positions at different angles to said plate, a first position in which said movable locking members are held in their operative locking position under the action of said biasing means, and a second position in which said toggle means is displaced to withdraw said movable locking members from their operative locking position against the action of said biasing means.

16. A combination according to claim 13, in which said plate has front and rear ends and lateral faces and said movable locking members are disposed at opposite parts of said lateral faces of said plate, said control member being disposed at one of said lateral faces of said plate, said control member being operatively connected to said toggle means by a laterally movable piece having a cam surface cooperating with said toggle means.

17. A combination according to claim 3, in which said at least one movable locking member is a lever pivotally mounted in said plate, aaid lever having a protruding beak forming a latch engageable in a corresponding recess in said face of said wall of the boot sole under the action of said biasing means, and voluntary unlocking means comprising a rod mounted in said plate parallel to the upper face thereof for rotation about the longitudinal axis of the rod, said rod including a projection cooperating with said lever to pivot said lever out of its operative locking position in response to rotation of said rod, and said rod further having a control member disposed externally of said plate for rotating the rod.

18. A combination according to claim 8, in which said voluntary unlocking means comprise two control members pivotally mounted about axes perpendicular to the upper face of said plate and cooperating with said levers to withdraw them from their operative locking position in response to pivoting of said control members apart from one another, said control members having extensions protruding side-by-side from said plate, and means for voluntarily moving said extensions apart from one another.

19. A combination according to claim 18, comprising means defining complementary profiles on said extensions for receiving the tip of a ski pole to move said extensions apart from one another.

20. A combination according to claim 18, comprising means defining an oval opening between said extensions, a rotatable shaft of corresponding oval cross-section passing through said opening, and a control member for rotating said shaft to move said extensions apart from one another.

21. A combination according to claim 3, in which said voluntary unlocking means comprise a pull-ring disposed externally of said plate.

22. A combination according to claim 3, in which said voluntary unlocking means comprise a piece slidably mounted in said plate, said piece having an extension protruding from said plate, said extension including an upturned extremity engageable by the tip of a ski pole for actuation of said piece.

23. A combination according to claim 3, in which each said locking member comprises a part protruding from said plate having an inclined upper surface cooperating with said peripheral wall of the boot sole to facilitate placing of the boot sole on said plate.

* * * * *

UNITED STATES PATENT OFFICE

CERTIFICATE OF CORRECTION

Patent No. 3,992,037 Dated November 16, 1976

Inventor(s) JEAN-PAUL FRECHIN

It is certified that error appears in the above-identified patent and that said Letters Patent are hereby corrected as shown below:

Col. 10, line 23, "aaid" should be --said--;

Col. 10, line 26, "and" should be --said--.

Signed and Sealed this

Eleventh Day of January 1977

[SEAL]

*Attest:*

RUTH C. MASON
*Attesting Officer*

C. MARSHALL DANN
*Commissioner of Patents and Trademarks*